US006276183B1

(12) United States Patent
Benedetti et al.

(10) Patent No.: US 6,276,183 B1
(45) Date of Patent: Aug. 21, 2001

(54) METHOD TO REDUCE AND ELIMINATE VIBRATIONS IN A ROLLING STAND AND RELATIVE DEVICE

(75) Inventors: Gianpietro Benedetti; Carlo Di Paolo, both of Campoformido; Estore Donini, Vimercate, all of (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 0 days.

(21) Appl. No.: 09/395,157

(22) Filed: Sep. 14, 1999

(30) Foreign Application Priority Data

Sep. 14, 1998 (IT) ..... UD98A0157

(51) Int. Cl.[7] ..... B21B 27/06

(52) U.S. Cl. ..... 72/236; 72/10.2; 72/41; 72/43

(58) Field of Search ..... 72/41, 42, 43, 72/249, 236, 10.2

(56) References Cited

U.S. PATENT DOCUMENTS

| | | |
|---|---|---|
| 3,134,279 | 5/1964 | Sims et al. . |
| 5,515,731 | 5/1996 | Weisshaar et al. . |

FOREIGN PATENT DOCUMENTS

| | | |
|---|---|---|
| 890928 | 4/1982 | (BE) . |
| 4408289 | 9/1995 | (DE) . |
| 2682896 | 4/1993 | (FR) . |
| 61-269903 * | 11/1986 | (JP) ..... 72/236 |

OTHER PUBLICATIONS

Butler et al, Compensation of a Digitally Controlled Static Power Converter For The Damping Of Rolling Mill Torsional Vibration—Applications Society Annual Meeting, vol. 1 No. 25, Oct. 7, 1990, Institute of Electrical and Electronic Engineers.

Gallenstein Torsional Chatter On A 4–H Cold Mill, vol. 58, No. 1, Jan. 1981 pp 52–57.

Patent Abstracts of Japan, vol. 13, No. 582 (M–911) Dec. 21, 1989 & JP 01 245905 A (Kobe Steel) Oct. 2, 1989.

Patent Abstracts of Japan, vol. 95, No. 003 Apr. 28, 1995 7 JP 06 344010 A (Nippon Steel) Dec. 20, 1994.

Patent Abstracts of Japan, vol. 96, No. 011, Nov. 20, 1996, & JP 08 174035 A (Hitachi Ltd) Jul. 9, 1996.

Patent Abstracts of Japan, vol. 11, No. 39, Feb. 5, 1987 & JP 61 206512A Nippon Kokan) Sep. 12, 1986.

* cited by examiner

*Primary Examiner*—Ed Tolan
(74) *Attorney, Agent, or Firm*—Antonelli, Terry, Stout & Kraus, LLP

(57) ABSTRACT

Method and device to reduce and eliminate vibrations in a rolling stand for plane rolled products comprising working rolls associated with by motor a kinematic chain, there being included nozzles to deliver a mixture of water and lubricant to the surface of each of the working rolls; the method providing to measure the effective value of torque transmitted to each of the working rolls and to selectively vary the percentage of lubricant contained in the mixture delivered to each of the working rolls according to the effective torque measured.

19 Claims, 3 Drawing Sheets

METHOD TO REDUCE AND ELIMINATE VIBRATIONS IN A ROLLING STAND AND RELATIVE DEVICE

FIELD OF THE INVENTION

This invention concerns a method to reduce and eliminate vibrations in a rolling stand, and the device which achieves the method.

The invention is applied in the rolling of strip, sheet and wide plate in processes which employ rolling stands, for example four-high stands comprising pairs of working rolls associated with respective back-up rolls, and where the working rolls are driven by means of transmission elements connected to the drive means by a kinematic chain.

The invention is also applied in two-high rolling stands which do not have back-up rolls, or five-high or six-high rolling stands or similar.

BACKGROUND OF THE INVENTION

In rolling trains for plane products, such as strip, sheet and wide plate, the state of the art includes rolling stands, generally four-high, arranged in sequence, which progressively reduce the thickness of the product in transit.

In the roughing and pre-finishing passes, each rolling stand normally causes a reduction in thickness of a value between 30% and 50% compared with the thickness at inlet; the reduction limit is defined by the maximum value of the angle at which the rolled stock enters, the maximum rolling torque which can be applied and by the maximum rolling force.

The final thickness of the product is then defined either in a reversible finishing rolling mill for sheet or strip (for example of the steckel type), or in a finishing train with stands in tandem, wherein the percentages of reduction can generally be between 65% and 15% compared with the thickness at inlet.

In four-high rolling stands there are working rolls which act directly on the product to be rolled, and back-up rolls, of larger diameter and cooperating with a relative working roll, which have the function of supporting the rolling loads and, in particular, preventing flexions and deformations of the relative working rolls.

Motion is normally supplied to the working rolls of each rolling stand, particularly in finishing stands, but very often nowadays in roughing stands too, by means of transmission elements, known as spindles, which are moved by a single drive means though appropriate assemblies to reduce and double the motion.

Using a single drive means for both rolls theoretically ensures the transmission of an identical speed of rotation to the shafts of the rolls, so that, again theoretically, it reduces the possibility of an irregular and non-uniform drawing action of the rolled stock during the rolling pass.

However, in practice it has been found that, even when the speed of the spindles which transmit motion to the working rolls is constant and identical, as transmitted from the source of motion, the resistant torque of the two rolls is not the same, and this causes considerable irregularities in the rolling process, which negatively influence the functioning of the rolling stand.

On this point, please refer to the theoretical explanation given by Tselikov in "Stress and strain in metal rolling", Mir Publishers—Moscow 1967, chapter IV "Direction of the forces acting on the rolls during rolling", and particularly paragraphs 6, 7, 9 and 11.

According to measurements carried out on industrial plants, it has been found that a great difference between the torque transmitted by the upper spindle and the torque transmitted by the lower spindle, exceeding a standard ratio such as 40/60 (or 60/40), causes a tendency for the rolling process to become unstable, since horizontal thrusts occur on the rolled product.

These horizontal thrusts are due to the fact that, when there is a difference in the torque transmitted to the two working rolls, the rolling force which each roll transmits to the rolled stock tends to deviate from the vertical, generating respective horizontal components of an opposite direction and a variable intensity according to the entity of this difference.

The greater the horizontal forces, the more easily vibrations can occur, and these make the rolling force oscillate both in intensity and in direction.

If in addition to the dis-uniform torque we add the little irregularities in the transmission of motion between the two working rolls—irregularities caused by the mechanical parts which transmit motion from the motor to the rolls—vibrations, even strong vibrations, may be generated on the structure of the stand inasmuch as each roll tends to draw the rolled stock in a different way.

This makes the relative horizontal components of the rolling force dissimilar, and has repercussions on the rolls themselves and on the relative chocks.

Moreover, the rolled stock comes to be drawn irregularly and jerkily, which can cause damage and surface markings of the rolled stock and the rolling rolls.

There are very many factors which can cause different torque values transmitted to the two rolls.

A first cause is the different temperature of the two faces of the rolled stock and/or the different surface temperature of the working rolls.

A second cause is the different roughness of the working rolls.

Both the first and the second cause can be determined, for example, by the formation of pools of water on the upper face of the rolled stock due to inappropriate maintenance conditions.

Another cause is a different diameter of the working rolls, caused by different wear on one roll and the other or by grinding operations not carried out correctly.

A further cause is an inaccurate centering of the rolled stock with respect to the median plane of the rolls.

A further cause is a non-uniform metallic structure of the two faces of the rolled stock.

All these causes, and others, individually or combined, can cause great irregularities in the share of the torque to the rolls and, consequently, horizontal vibrations of the rolls; these vibrations make the rolling force imparted by the working rolls oscillate and thus generate irregular rolling.

These vibrations may also be caused by irregularities in the transmission of the motion which, in turn, cause torsional vibrations of the kinematic chain.

Vibrations are also caused in the bearings and the chocks of the working rolls.

The frequencies of vibration are generally syntonised with the 1st, 2nd or 3rd torsional frequency of the kinematic chain.

The state of the art also includes the use of systems to cool the rolls using fluids, particularly water, which is sprayed onto the surface of the rolls by appropriate collectors and nozzles. In order to have a more efficient heat exchange, normally there are greater deliveries of water in proximity with the area where the rolled product exits from the stand.

The spraying means comprise, or cooperate with, protection means which prevent the formation of pools of water on the upper face of the rolled stock passing through.

The cooling means have a part function of making uniform the surface temperature of the working rolls, but they have a very limited effect (which in any case cannot be controlled) on the other shortcomings which make the torque uneven and consequently generate vibrations in the stand.

The article "Compensation of a digitally . . . ", by Butler et al., taken from the journal "Institute of electrical and electronics engineers" vol. 1, n. Meeting 25, Oct. 7, 1990, pages 583–588, describes various techniques to minimize the excitation of resonance frequencies which lead to torsional vibration of the kinematic chain which transmits motion to the rolls of a rolling stand.

One of these techniques provides to vary the lubrication and surface finishing of the rolls.

This document teaches an empirical method which provides to adopt a posteriori corrections and strategies, after having detected the presence of torsional vibrations, to reduce or cancel said vibrations.

In other words, if the worker becomes aware that there are vibrations present, he activates or modifies the lubrication conditions, according to his knowledge or by empirical means, to modify the friction between the strip being rolled and the working rolls.

The document therefore does not teach any connection between the dis-uniform torque transmitted by the spindles to the working rolls and the lubrication conditions in order to reduce or cancel the vibrations and oscillations in the rolling force.

BE-A-890.928 also provides to act on the lubrication of the rolls to reduce the vibrations, but does not provide any indication concerning a measurement of the dis-uniform torque transmitted to the rolls as a basic element to establish the correction of the lubrication conditions.

Both these prior art documents describe an empirical method, which can be based only on successive and approximate adjustments; therefore they do not provide any guarantee either that the method will function efficiently and rapidly, or that optimum working conditions can be maintained for an acceptable period of time.

The present Applicant has devised and embodied this invention to overcome these shortcomings which businessmen in this field have long complained of, and to obtain further advantages as will be shown hereafter.

SUMMARY OF THE INVENTION

The purpose of the invention is to achieve a method which will reduce to a minimum and even eliminate the vibrations of the working rolls in a rolling stand caused by the differences in the resistant torque of one working roll compared with the other.

If the rolling torque is shared on average in a uniform manner between the two working rolls, the disturbances to the rolling process arriving from the mechanical and electric parts and from the process itself, have no effect inasmuch as they are unable to generate instantaneous differences in torque between the two working rolls such as to make the rolling process unstable with horizontal movements of the rolling rolls and with horizontal components of the rolling force transmitted to the rolled stock.

To be more exact, the purpose of the invention is to compensate these torque differences and ensure in every situation the regularity and uniformity of the rolling torque of the two working rolls.

A further purpose is to achieve a device suitable to monitor substantially continuously the values of torque transmitted to each of the two rolls and to intervene substantially instantaneously and selectively during the rolling cycle, in the event of a difference in the torque values, in order to restore proper conditions and to eliminate the vibrations and oscillations caused by this difference.

The invention provides to use means, arranged at a desired position on the kinematic chain between the motor and the rolls, suitable to measure the real value of torque delivered to each of the working rolls.

These means are preferably arranged at a position near the rolls, preferentially in correspondence with the spindles, so as to guarantee the maximum sensitivity in measuring the differences in torque between one roll and the other.

The invention also provides means suitable to deliver on command and selectively onto the surface of each of the working rolls a jet of fluid, advantageously water, together with a desired percentage quantity of a lubricating element, advantageously oil or other similar substance.

According to a variant, the delivery means cooperate with the back-up rolls and the mixture containing the desired quantity of oil is transferred through contact from each of the back-up rolls to the relative working roll.

According to the invention, the delivery means are associated with means to adjust the percentage of oil contained in the lubricating mixture sprayed onto the rolls; these adjusting means are selectively conditioned according to signals arriving from the torque measuring means associated with one roll and the other.

To be more exact, if through these measuring means it is found that the torque transmitted to the first working roll is greater than that transmitted to the other working roll, the percentage of oil delivered together with the water to the first working roll is increased or, in a similar manner, the percentage of oil delivered to the second working roll is decreased.

The average percentage value is the percentage value of oil which reduces wear on the working rolls; once this value has been exceeded there is no tangible reduction in wear, whereas for lower percentages the wear is considerably increased.

In a variant, the percentage of oil delivered with the water is zero when there is a condition of stable or uniform torque; when the measuring means detect a non-uniform torque, a percentage of oil is delivered to the working roll which has a greater torque than the other working roll.

The invention provides processing means suitable to receive the information from the torque measuring means and to condition the means to adjust the percentage of oil to be added to the water delivered to the working rolls according to a ratio which is pre-set according to the value of the difference in torque transmitted to the two working rolls.

The presence of a mixture with a variable percentage of oil on the contact surface between the working roll and the rolled stock allows to compensate differences in torque inasmuch as it allows, for example, to reduce the friction between the rolls and the rolled stock when there is a greater torque, thus reducing the value of the torque; or, vice versa, to increase the friction, when there is a lower torque, and thus increase the value of the torque.

BRIEF DESCRIPTION OF THE DRAWINGS

The attached Figures are given as a non-restrictive example, and show some preferential embodiments of the invention as follows.

DETAILED DESCRIPTION OF THE PREFERRED EMBODIMENTS

Figures 1, 2:
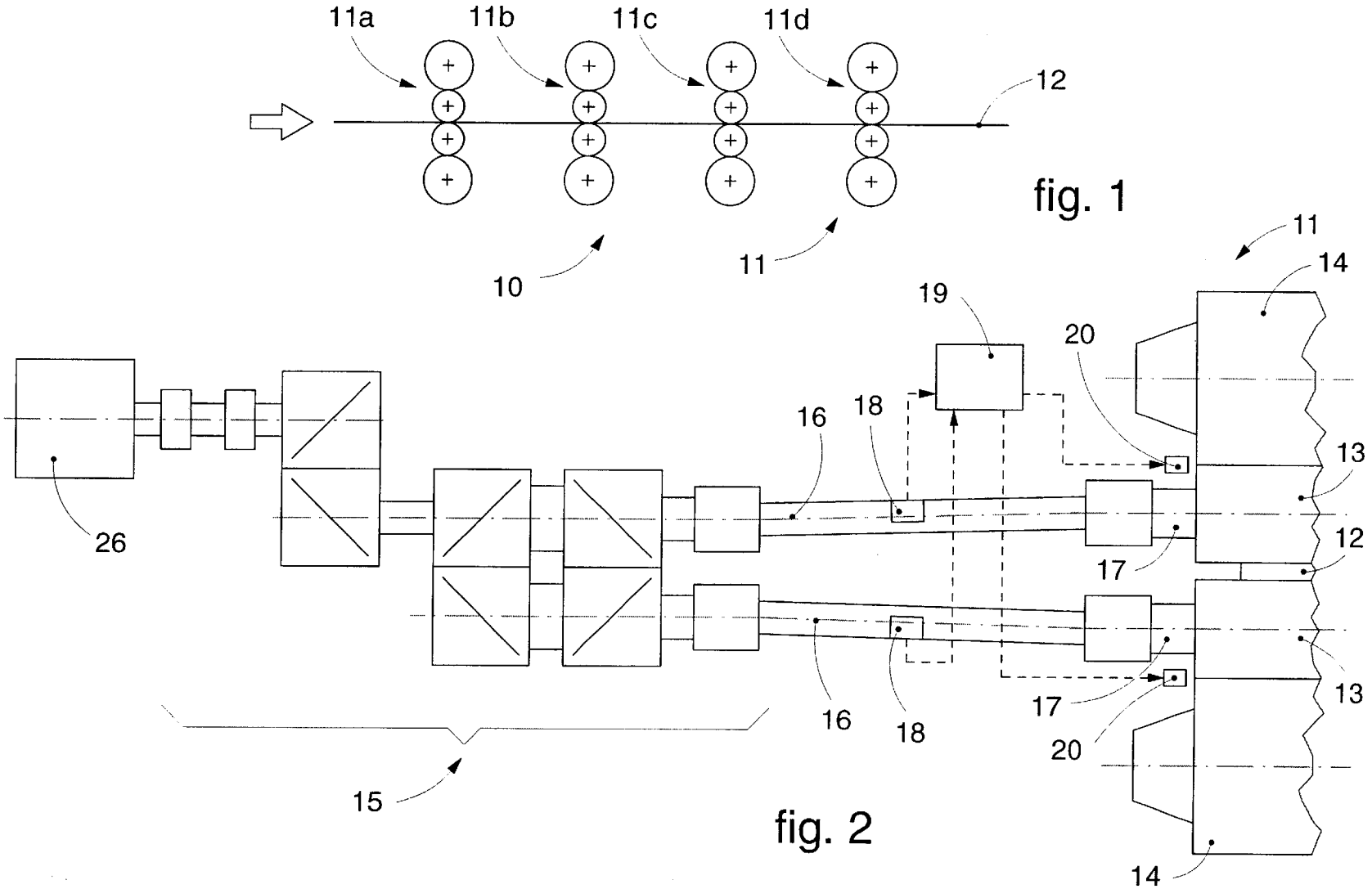
FIG. 1 is a diagram showing an example of a rolling train adopting the invention.
FIG. 2 is a diagram of the transmission of motion to the working rolls of a four-high rolling stand.

The rolling train 10 shown partly and in diagram form in FIG. 1 comprises, as an example, four rolling stands 11, in this case four-high stands 11*a,* 11*b,* 11*c* and 11*d,* arranged in sequence so as to perform progressive reductions in the thickness of a strip or plate 12 passing through. The invention is applied in the same way to roughing trains with 1 or 2 reversible or non-reversible stands, to pre-finishing trains with 1 or 2 non-reversible stands, to finishing trains with from 3 to 7 stands, to reversible finishing stands of the single type or of the tandem type such as is known in the state of the art by the name of steckel mill, inserted in any rolling line for plane products.

Each stand 11 comprises, in this case, a pair of working rolls 13 and a mating pair of back-up rolls 14.

Motion is supplied to the working rolls 13 (FIG. 2) by means of a single drive means 26 which, by means of reduction gear boxes indicated in their entirety by the reference number 15, transmits motion to respective spindles 16 associated with the respective rotation shafts 17 of the rolls 13.

Figure 3:
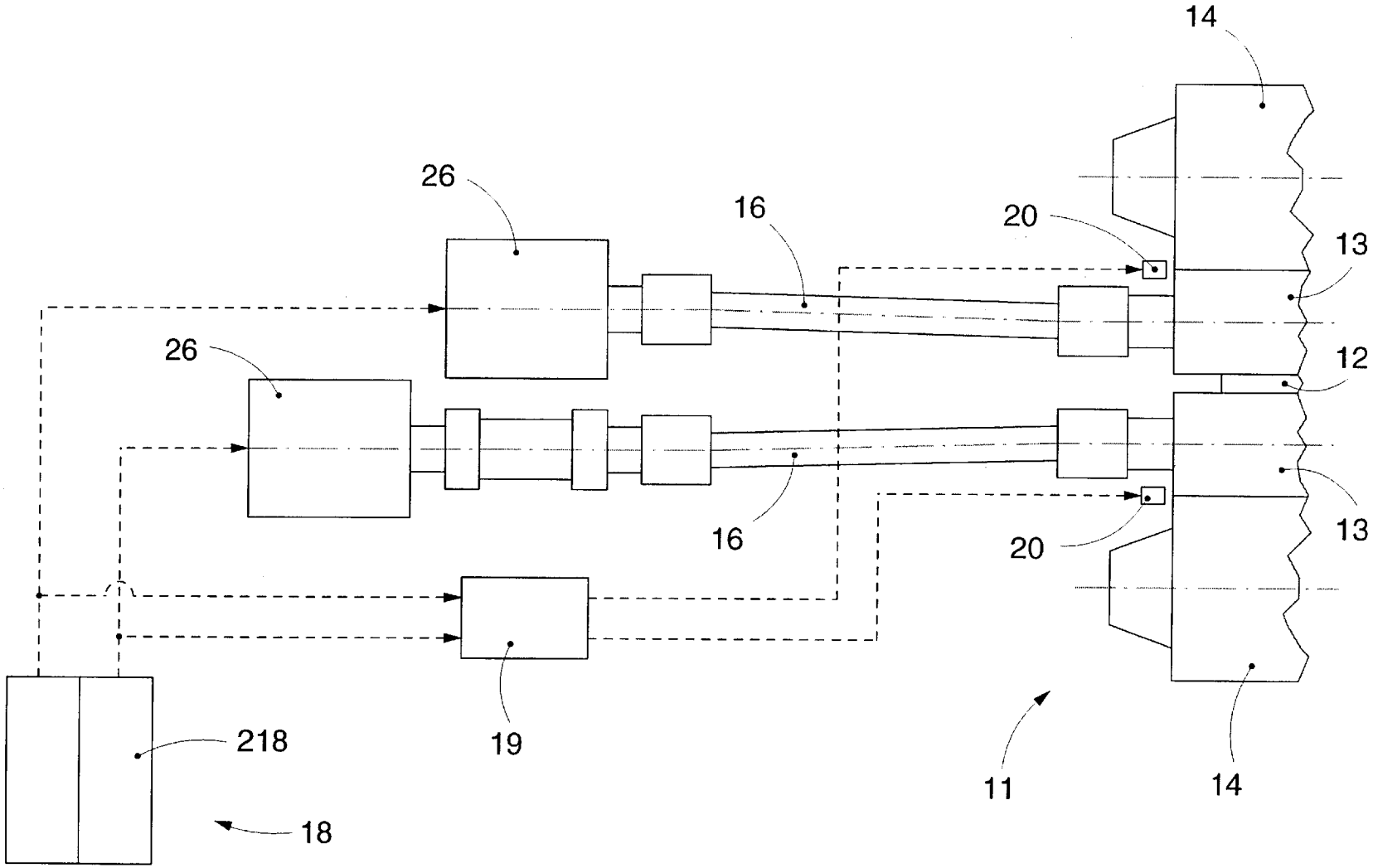
FIG. 3 shows a variant of FIG. 2 with the transmission of motion of the twin-drive type, to two independent motors.

According to the variant shown in FIG. 3, the motion command is of the twin-drive type, that is to say, with two independent motors 26, each of which commands a relative working roll 13, with or without intermediate reducers 15 and by means of the spindles 16.

The invention provides means 18 to measure, continuously or at pre-set intervals, the actual torque transferred to each working roll 13 by the respective command means during the rolling cycle.

In the embodiment shown in FIG. 2, the means 18 consist of detector elements 118 included in cooperation with the spindles 16.

In the variant shown in FIG. 3, the means 18 consist of a control device 218 which acquires, processes and compares the electrical sizes of each independent motor 26.

The means 18 are connected to a processing unit 19 suitable to compare the torque values to detect a possible difference, and to condition, if there is a difference and according to the entity thereof, the delivery of a mixture of water and lubricant, advantageously oil, in correspondence with the surface of the rolls.

To be more exact, the processing unit 19 is provided to vary the percentage of oil in the mixture delivered, selectively for every roll, by increasing the percentage to the roll with the greater torque and/or reducing the percentage of oil to the roll with the lesser torque.

The processing unit 19 (FIGS. 2 and 3) is suitable to send command signals to delivery means 20 arranged in proximity with the surface of the respective rolls, the working rolls 13 and the back-up rolls 14. The delivery means 20 comprise at least a nozzle 21 to deliver the water-oil mixture and means 22 to adjust the percentage of oil in the mixture; the conduits of water and oil, respectively 23 and 24, flow into the means 22.

The adjustment means 22 may consist of a proportional valve, a Venturi system or other appropriate mixing system able to vary substantially instantaneously the percentage of oil in the mixture according to the commands sent by the processing unit 19.

Figure 4:
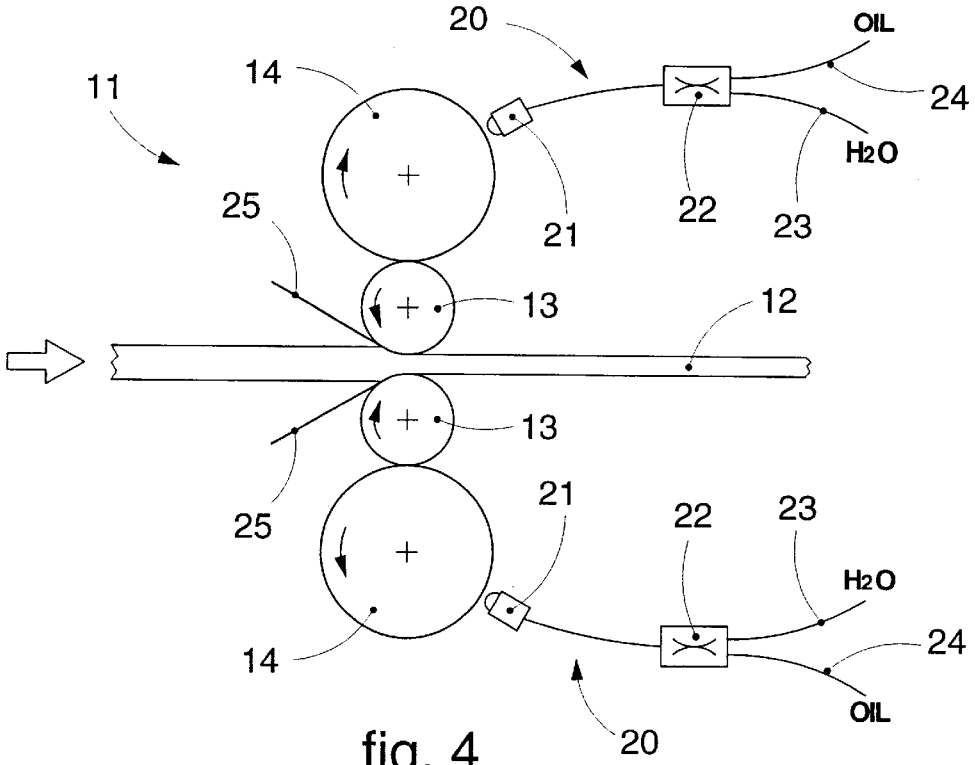
FIG. 4 shows a detail of a first embodiment of the invention.

In FIG. 4, the delivery nozzle 21 co-operates with the surface of a relative back-up roll 14 and the mixture delivered is transferred through contact to the surface of the relative working roll 13.

In cooperation with the area where the rolled stock 12 enters there is a shutter 25 which prevents the formation of pools of mixture on the upper face of the rolled stock 12.

Figure 5:
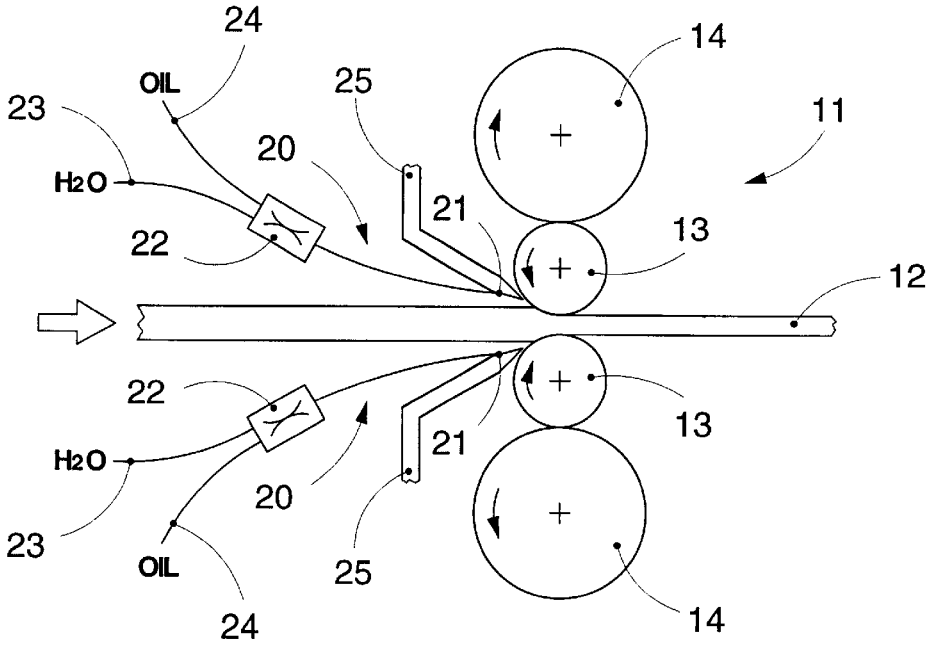
FIG. 5 shows a variant of FIG. 4.

According to the variant shown in FIG. 5, in order to have an even quicker response to the variations in torque detected by the measuring means 18, the mixture is delivered directly onto the surface of the working rolls 13, in proximity with the area where the rolled stock 12 enters, by a delivery nozzle 21 assembled on a protective shutter 25, which also protects the nozzle 21 from knocking against the rolled stock.

The invention functions in this way:

When the rolling cycle is started, or when there is a condition of equal torque applied to the two working rolls 12, the water-oil mixture delivered by the nozzles 21 to each of the two rolls 12 contains an equal percentage of oil, which can also be nil, or equal to the optimum percentage suitable to reduce wear on the working rolls without needlessly increasing the consumption of oil.

When the processing unit 19, according to the measurements made by the measuring means 18, detects a difference in torque between the two working rolls 13 which exceeds a first pre-set threshold, percentage or absolute, it acts selectively on one or on both the adjustment means 22 to cause an increase in the percentage of oil delivered to the working roll 13 with the greater torque, and/or a reduction in the percentage of oil delivered to the working roll 13 with a lesser torque.

This adjustment is continued until the measuring means 18 detect that a condition of substantially equal torque is restored, for example with a value of difference in torque below a second threshold which is lower than the first threshold; when this condition has been reached, the percentage of oil in the respective mixtures remains stabilised until a new condition of difference in torque occurs.

The increase in the percentage of oil delivered to the working roll 13 with the greater torque causes a lesser friction between the roll 13 and the rolled stock 12, and the excess torque is consequently discharged and regular conditions are restored in the division of torque; this reduces the danger of vibrations starting due to disturbances of a mechanical, electrical or processing origin.

In fact, if the torque delivered to the two rolls 13 is substantially equal, the resultant of the rolling force is perfectly vertical, and therefore there are no oscillating and opposing horizontal forces on the rolls which might cause a horizontal movement thereof, with a consequent start of vibrations.

In this way we obtain, with a simple system, rapid response times and which has no effect at all on the lay-out and structure of the stands 11, a method which reduces to a minimum, and even eliminates, the vibrations of the stands and the irregularities in the division of torque to the working rolls 13, with obvious advantages in terms of rolling efficiency and surface quality of the rolled stock 12 obtained.

Modifications and variations may be made to this invention, but these shall remain within the field and scope of the attached claims.

For example, instead of varying the percentage, or only the percentage, of lubricant contained in the mixture, it is within the spirit of the invention to provide to vary the type of lubricant too, for example by selecting it from a plurality of containers of different lubricants which can be associated selectively to the delivery means 20.

What is claimed:

1. Method to reduce and eliminate vibrations in a rolling stand for plane rolled products, the rolling stand comprising working rolls associated with drive means by means of a kinematic chain, there being included means to deliver a mixture of water and lubricant to the surface of each of the working rolls, the method comprising measuring, along said kinematic chain, the effective value of torque transmitted to each of said working rolls; and selectively varying the percentage of lubricant contained in the mixture delivered to each of said working rolls according to any measured difference in torque transmitted to said working rolls.

2. Method as in claim 1, wherein the step of selectively varying the percentage of lubricant contained in the mixture comprises increasing the percentage of lubricant contained in the mixture delivered to the working roll which has a greater effective torque than the other working roll.

3. Method as in claim 2, wherein the step of selectively varying the percentage of lubricant contained in the mixture comprises decreasing the percentage of lubricant contained in the mixture delivered to the working roll which has a lesser effective torque than the other working roll.

4. Method as in claim 1, wherein the step of selectively varying the percentage of lubricant contained in the mixture comprises decreasing the percentage of lubricant contained in the mixture delivered to the working roll which has a lesser effective torque than the other working roll.

5. Method as in claim 1, that, in ideal rolling conditions, that is, with perfect and symmetrical friction, roll wear, temperature, rolled stock wherein under a condition of substantially equal torque of the two working rolls, the percentage of lubricant contained in the mixture which is delivered is the same for both working rolls.

6. Method as in claim 5, wherein, under the condition of substantially equal torque of the two working rolls, the percentage of lubricant contained in the mixture which is delivered is nil for both working rolls.

7. Method as in claim 1, wherein the rolling stand is a four-high rolling stand with said working rolls associated with respective back-up rolls, and wherein the water-lubricant mixture is delivered in correspondence with a surface of said back-up rolls.

8. Method as in claim 1, further comprising together or in alternation with the variation in the percentage of lubricant contained in the mixture delivered to said working rolls, selectively varying the type of lubricant according to the difference in the torque transmitted to said rolls.

9. Device to eliminate vibrations in a rolling stand for plane rolled products such as strip or sheet, comprising working rolls associated with drive means by means of a kinematic chain comprising transmission elements connected to a rotary shaft of said working rolls, delivery means being included to deliver a mixture of water and lubricant to the surface of each of the working rolls, the device being characterised in that it comprises measuring means suitable to measure the effective value of torque transmitted to each of the working rolls and processing means suitable to receive the signals arriving from said measuring means, to calculate a possible difference between the values of torque transmitted to each of the working rolls and to condition said means delivering a mixture of water and lubricant to the surface of the working rolls in order to vary the percentage of lubricant contained in said mixture according to the said difference in the torque values.

10. Device as in claim 9, characterised in that said drive means are the same for both working rolls and said measuring means consist of detector elements arranged at any position whatsoever along said kinematic chain between said drive means and the relative working roll.

11. Device as in claims 9, characterised in that the transmission elements consist of spindles and that said detector elements are arranged in cooperation with each of said spindles.

12. Device as in claim 9, characterised in that said drive means are independent for the two working rolls and said measuring means consist of a control device which acquires, processes and compares the electrical sizes of each of said independent drive means.

13. Device as in claim from 9, characterised in that said delivery means comprise at least a delivery nozzle cooperating with the surface of the relative working roll and means to adjust the percentage of lubricant contained in the mixture delivered, said adjustment means being governed by said processing means.

14. Device as in claim 9, characterised in that said delivery nozzle is assembled on a shutter arranged in proximity with an area where the rolled stock enters the stand and suitable both to prevent the formation of pools of mixture on the upper face of the rolled stock and any knocks against the rolled stock itself.

15. Device as in claim 9, characterised in that said rolling stand is the four-high type, with back-up rolls associated with each of said working rolls, and that said delivery nozzles are provided in cooperation with the surface of each of said back-up rolls.

16. Device as in claim 9, characterised in that said rolling stand is included in a roughing rolling train with 1 or 2 reversible or non-reversible stands.

17. Device as in claim 9, characterised in that said rolling stand is included in a pre-finishing rolling train with 1 or 2 reversible or non-reversible stands.

18. Device as in claim 9, characterised in that said rolling stand is included in a finishing rolling train with from 3 to 7 stands.

19. Device as in claim 9, characterised in that said delivery means are also suitable to deliver selectively, onto the surface of said working rolls, lubricants of various types, the lubricant to be delivered being selected according to the difference in the values of torque detected by the measuring means.

* * * * *